United States Patent [19]

Williams

[11] 4,339,085

[45] Jul. 13, 1982

[54] REVERSIBLE MATERIAL REDUCING MILL

[76] Inventor: Robert M. Williams, 16 La Hacienda, Ladue, Mo. 63124

[21] Appl. No.: 139,844

[22] Filed: Apr. 14, 1980

[51] Int. Cl.[3] ..... B02C 13/288

[52] U.S. Cl. ..... 241/62; 241/73; 241/81; 241/186 R

[58] Field of Search ..... 241/73, 81, 48, 189 A, 241/189 R, 186 R, 52, 47, 62

[56] References Cited

U.S. PATENT DOCUMENTS 3,088,683 5/1963 Joseph et al. ..... 241/86.2 X 3,667,694 6/1972 Williams ..... 241/189 A X 3,702,682 11/1972 Williams ..... 241/48

3,794,251 2/1974 Williams ..... 241/81 X

*Primary Examiner*—Mark Rosenbaum

*Attorney, Agent, or Firm*—Gravely, Lieder & Woodruff

[57] ABSTRACT

A reducing mill for handling a wide variety of trash and waste material needing reduction to a state for easy subsequent handling and for separating certain components of the material by a specific gravity characteristic. The reducing mill embodies means for mixing and segregating components of the trash and waste material by the combined jet and negative pressure gradient induced by the action of an air stream, and by the cooperation of a hammer mill housed in a casing formed to effect recycling of material which needs or may require recirculation for further reduction and segregation.

7 Claims, 5 Drawing Figures

REVERSIBLE MATERIAL REDUCING MILL

BACKGROUND OF THE INVENTION

This invention relates to trash and waste material reducing apparatus, and is particularly directed to improvements in the effective handling and reduction of such materials in a hammer mill.

Material reducing apparatus which has preceded the present apparatus has embodied the use of air for moving the material as in Williams U.S. Pat. No. 3,702,682 of Nov. 14, 1972, or has embodied reversible hammer rotors and control over the position of breaker plates as in Williams U.S. Pat. No. 3,667,694 of June 6, 1972. Other prior art includes Leggett U.S. Pat. No. 1,751,009 of Mar. 18, 1930; Hartshorn U.S. Pat. No. 2,287,799 of June 30, 1942; Gondard U.S. Pat. No. 3,082,963 of Mar. 26, 1963; and Meyer U.S. Pat. No. 3,442,458 of May 6, 1969. However, the present mixing and segregation of the various fractions of trash and waste material by a controlled air stream and vacuum agitation is new and unique over the foregoing examples of the prior art.

The general objects of the present invention are to combine in a unique way a hammer mill in a housing with a more efficient and positive manner of mixing and segregating waste material and trash in an air stream, and to provide means in the housing for subjecting the trash and waste to a controllable air stream which breaks up clustered material and allows the heavy material to fall out and not get trapped in a recirculating orbit, or return to the hammer mill more than a minimum number of times.

A more specific object of the present invention is to provide a controllable high velocity air stream past the delivery end of material feeding means, and provide a negative pressure gradient or partial vacuum area adjacent the delivery end of the feeding means for effecting a thorough mixing and jet action.

A further object of the present invention is to provide a material reducing mill of reversible character in combination with the structure and means pointed out above and to be described below, all of which provides improved results.

BRIEF DESCRIPTION OF THE DRAWINGS

The preferred embodiments of the present invention are shown in the accompanying drawings, wherein.

DETAILED DESCRIPTION OF THE EMBODIMENTS

Figure 1:
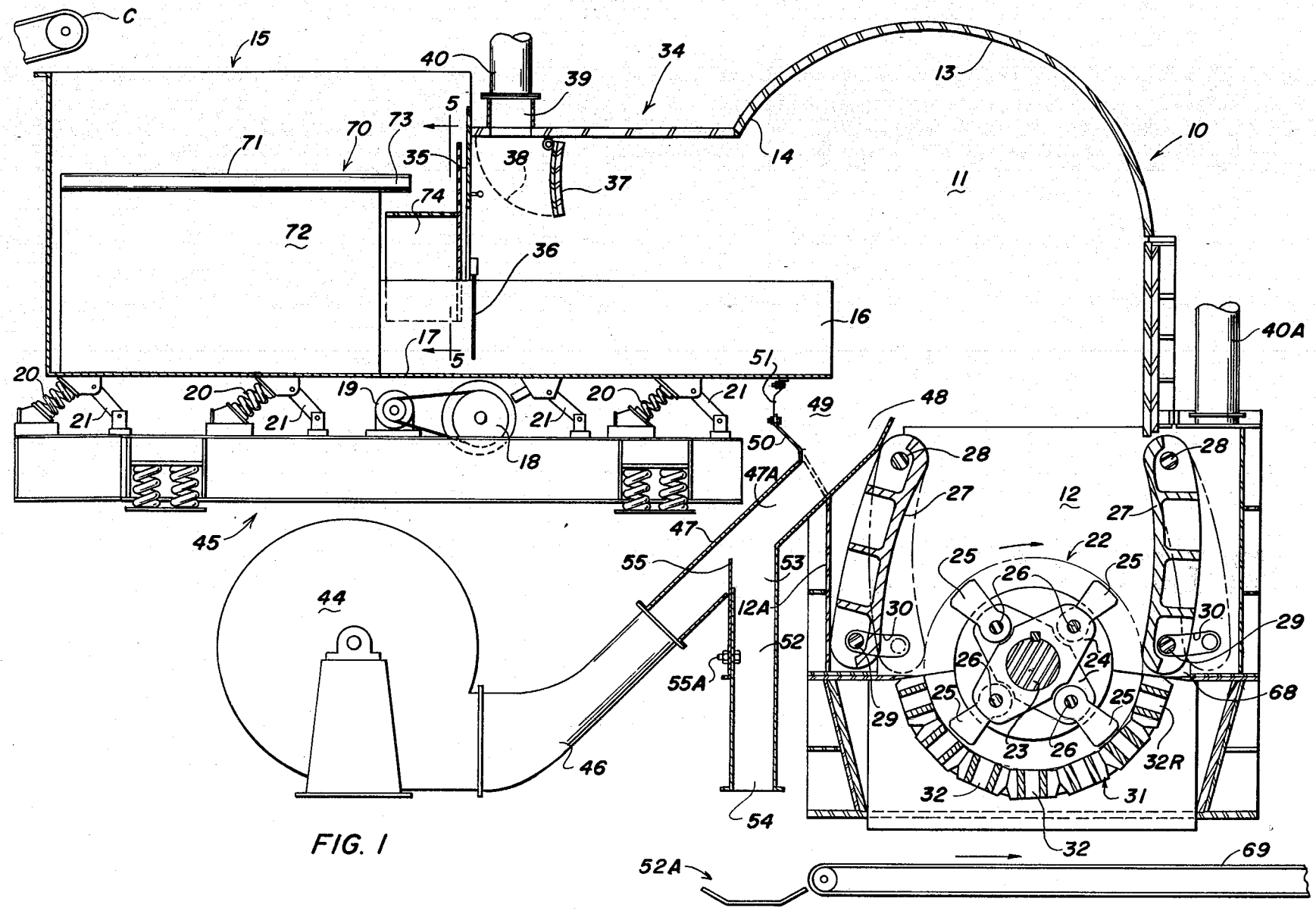
FIG. 1 is a sectional elevational view of a material reducing mill showing principal components of importance.

Referring now to the drawings, and particularly to FIG. 1, there is shown a sectional elevational view of the material reducing mill in which the enclosure 10 provides an upper material mixing area 11 and a lower material reducing area 12 arranged in substantially vertically related communication. The upper material mixing area is provided with an arched wall 13 which has an extremity 14 disposed so that material following the curvature of the arched wall 13 will be directed into feeding means 15 so as to return to the trash and waste material being transported by the feeding means toward its discharge end 16 which is in the mixing area 11. The feeding means comprises a tray structure connected by its bottom wall 17 to an eccentric member 18 driven by motor 19. The bottom wall 17 is supported on a plurality of springs 20 in combination with links 21 so that the feeding means 15 will be caused to vibrate in a generally horizontal plane but with the result that trash and waste material deposited therein by a supply conveyor C will be advanced toward and pass off the discharge end 16. Of course, side walls are provided in order to complete the enclosure 10.

The material reducing area 12 (FIG. 1) is constructed and arranged to support a rotary hammer assembly 22 in which a shaft 23 carries a plurality of supports 24 for the purpose of forming the connection for hammers 25 which are connected to the supports 24 on suitable pivot pins 26. It can be seen that the reducing area 12 is provided with breaker plates 27 arranged on opposite sides of the rotary hammer assembly 22. The breaker plates 27 are pivotally supported on shafts 28 at their upper ends, while the lower ends are provided with shafts 29 which are adapted to project outwardly of the side wall structure through suitable slots 30 which have a curved form with the center thereof substantially in the axis of the pivot shafts 28. The rotary hammer assembly, below the breaker plates 27, is enclosed by a cage assembly 31 made up of a plurality of cage bars 32 providing openings for the passage of the material which has been reduced by the action of the rotary hammers 25 to a size that will pass through the cage bar openings.

FIG. 1 also shows that the arched wall 13 over mixing area 11 has a portion thereof defined by a hood structure 34 extending over a part of the feeding means 15. The hood structure 34 is provided with an end wall 35 which supports an adjustable curtain 36 pivoted at 36A on the end wall 35 and projecting into the feeding means 15 for limiting the passage of air between the exterior and the mixing area. In addition to the curtain 36, the hood structure supports a deflector plate 37 which may be adjusted in position along its arcuate path 38 so as to deflect heavy objects which may get into the area adjacent the plate 37. The deflector plate 37 acts as a guard for an air outlet port 39 which opens through the hood 34 and connects with a conduit 40.

Figure 2:
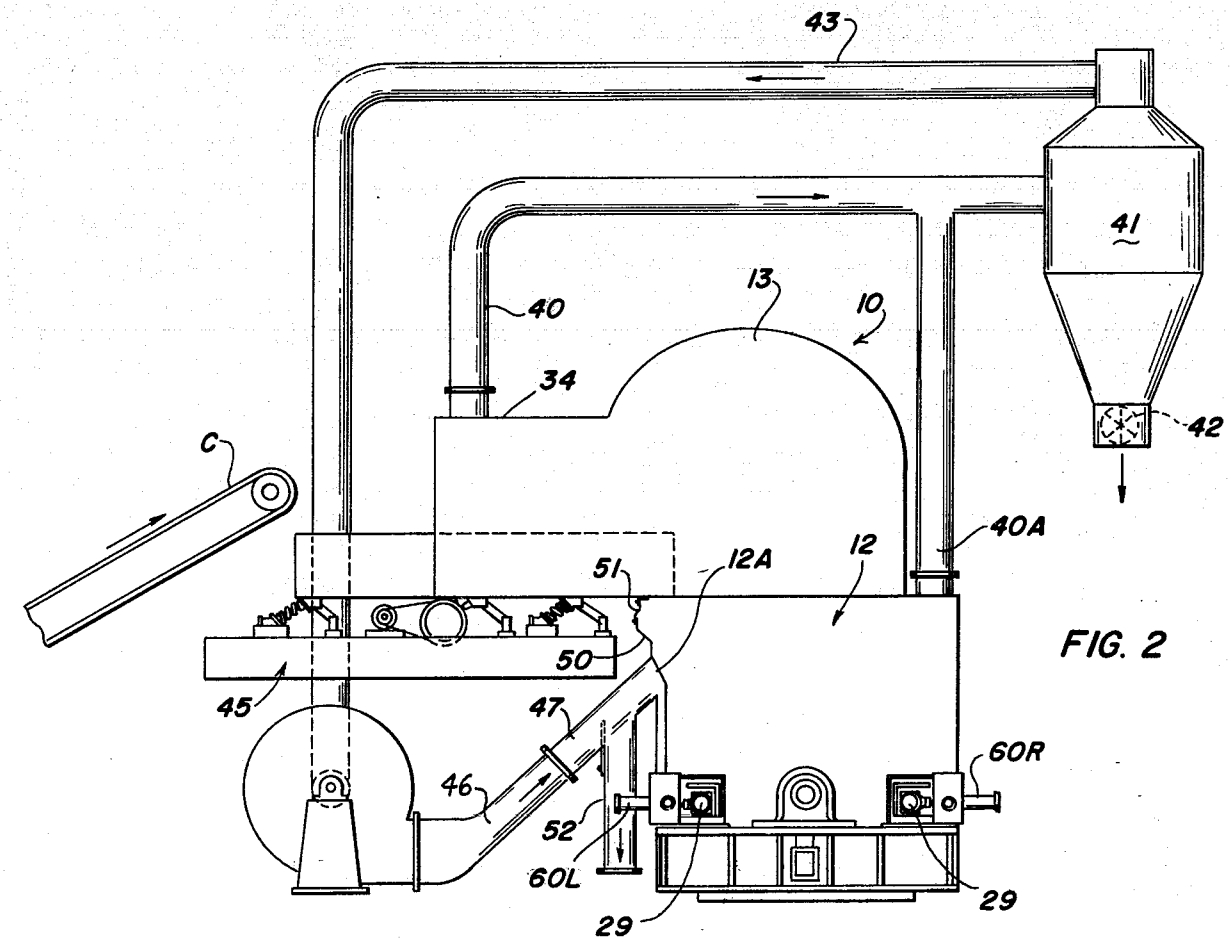
FIG. 2 is an elevational view of the reducing mill and its cooperating components.

The view of FIG. 2 shows conduit 40 connected to a cyclone separator 41 where lightweight objects and dust can be centrifugally extracted and discharged from the separator 41 through a rotary valve 42. Additionally, air is moved from the material reducing area 12, along with dust and fines, by conduit 40A which connects up with conduit 40 in advance of the cyclone separator 41. Air which has been centrifugally cleaned in the separator 41 is returned through a conduit 43 to the inlet side of a blower 44. The blower is mounted on a suitable base in a position below the supporting structure 45 for the vibratory feeding means 15, and is driven by a suitable motor (not shown).

The blower 44 has its discharge conduit 46 connected to an air flow conduit 47 (FIG. 1) which extends through the side wall 12A of the area 12 and is formed with a discharge end 48 located in the mixing area 11 adjacent the discharge end 16 of the feeding means 15. There is a pocket 49 formed just below the discharge end 16 of the feeding means by a suitable wall 50 which is connected to or may be a part of the conduit 47 but directed laterally with respect to the longitudinal axis of such conduit. Lateral wall 50 is connected to the vibratory feeding means by a flexible wall 51 so that the action of the feeding means 15 will not be restricted by the conduit 47. It can be seen in FIG. 1 that the conduit 47 is formed with a chute 52 which extends downwardly from the underside of the conduit 47 so that material passing downwardly through the conduit 47 may enter the chute 52 at the opening 53. The bottom end 54 of the chute 52 is adapted to be open to allow air to flow inwardly to conduit 47, and a suitable conveyor 52A is positioned to catch the material and move it to a suitable location.

It has been discovered in controlling the velocity of the air stream moved through the conduit 47 and past the pocket 49 that material passing off the discharge end 16 of the feeding means 15 is drawn into the pocket 49 prior to being picked up in the air flow through the discharge end 48 of the conduit 47. It has also been discovered that control over the movement of the material into the pocket 49 and then into the mixing area 11 can be obtained by the presence of a movable gate 55 slidably supported on a wall of the chute 52 and directed so as to project across a portion of the conduit 47 for the purpose of varying the velocity of the air stream in the conduit 47. The gate 55 is held in moved position by one or more threaded holding elements 55A.

The presence of the gate 55 controls the velocity of the air flow past the pocket 49 with the result that a negative pressure gradient is produced in the pocket 49 and material leaving the discharge end 16 of the feeding means 15 is flipped over and turned so the material that is vibrated to the bottom layer in means 15 will be released from being trapped under larger material as the material moves into the pocket by the flow of air induced by the negative pressure gradient before being picked up in the high speed air stream and propelled into the mixing area 11. During the movement of the material into pocket 49, it will gain velocity such that the portions of higher specific gravity and larger size will be induced to fall through the high speed air stream and pass out through discharge chute 52, while the smaller and lighter weight components will pass into the area 11 and fall into the area 12 for reduction by the rotary hammer assembly 22. The portions falling through the high speed air stream will be subjected to a scrubbing action which will strip off most lightweight fractions which still cling to the portions destined to fall through the high speed air stream.

Figure 3:
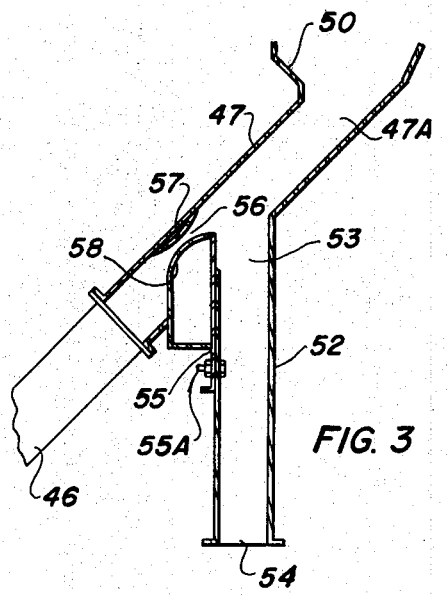
FIG. 3 is a fragmentary sectional view of a modification relating to means for controlling the character of air stream employed for subjecting the waste material to mixing and specific gravity segregation.

Referring now to FIG. 3, there is shown a modification of the air flow control means. In this structure, a full Venturi throat 56 is created by mounting a stationery throat element 57 on the wall of the conduit 47, and providing a movable Venturi throat wall 58 on a plate 59 which would replace the flat plate 55 shown in FIG. 1. The Venturi has been found to be more energy efficient than the flat plate type orifice.

The action of the adjustable plate 55, or that of the Venturi forming means 57 and 58, is believed to be one in which the flow of air entering conduit 47 is squeezed down and experiences an increase in velocity with a reduction in pressure. The air after passing the plate 55 expands in an effort to fill the volume of the conduit space 47A. However, the blower 48 cannot supply the deficiency so air is drawn in through chute 52 and further air is drawn in from the feeder 15 over its discharge end 16. The latter air flow flips the material into the pocket 49 and causes it to tumble and to turn over, which aids in the break up of clusters of material and entrapped granular material. The mixing, tumbling and other motions imparted to material in or entering the pocket 49 is responsive to the selected position of the plate 55, or the Venturi portion 58, such that adjustments can be made to suit the character of the trash and waste material being processed. Moreover, it has been found that the material drawn with air over the discharge end 16 of the feeder means 15 increases its downward velocity and improves the normal gravity separation of heavy objects of a non-crushable type by adding the velocity effect to the gravity effect.

Figure 4:
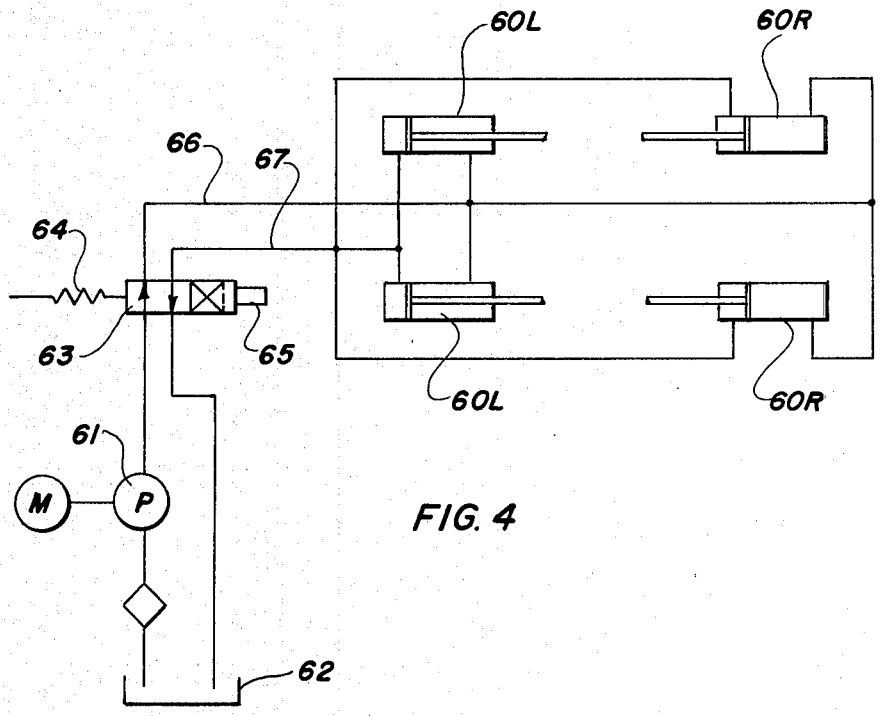
FIG. 4 is a schematic view of means for controlling the position of the breaker plates which cooperate with the rotary hammers to permit effective reversible operation thereof.

It has been pointed out that the breaker plates 27 are movable for controlling the path of travel of material thrown back into the mixing area 11 by the assembly 22. Each breaker plate 27 has the opposite ends of the shafts 29 connected to hydraulic cylinders (FIG. 4) arranged such that the left cylinders 60L move its plate 27 in a direction opposite to the way the right cylinders 60R move its plate 27. Thus, as the right hand breaker plate is moved toward the hammer assembly 22, the left hand breaker plate 27 is moved back or away from the hammer assembly 22. The system for supplying pressure fluid to the cylinders includes a pump 61 driven by motor M and supplied with hydraulic fluid from a reservoir 62. The pump 61 delivers fluid to a reversing valve 63 which is responsive in one setting to spring 64 and in an opposite setting to a solenoid 65. Thus, the supply conduit 66 and return conduit 67 can be reversed in function as is indicated by the full line and broken line positions of the plates 27 in FIG. 1 by shifting the valve 63 through manipulation of the solenoid 65.

The position of the breaker plates 27 is determined by the direction of rotation of the hammer assembly 22 so that the right hand breaker plate 27 first encountered by the direction of travel of the hammers 25 (see FIG. 1) performs the material shredding reduction and the opposite or left hand breaker plate 27 is moved away from the path of travel of the hammers 25 so as to guide any non-crushables thrown out by the hammers into the mixing area 11 for cooperation with the arched wall 13. The material thrown out in this manner is directed by the arched wall 13 to return to the feeder means 15 where it can co-mingle with the trash and waste material and move into the pocket 49. Thus, if the returned material possesses the necessary specific gravity, it may escape through the conduit 47 and fall into the chute 52. The arrangement of the apparatus enables non-crushables entrapped in the trash and waste material to be disassociated by impact with the rotary hammer assembly and to be returned to the feeding means 15 for subsequent escape.

It is observed in FIG. 1 that if the right hand breaker plate 27 is moved to the broken outline position there is provided a gap or space 68 between the bottom of such plate and the adjacent grate bar 32R. This space 68 is provided so that should hard-to-reduce material remain in the reducing area 12 or keep returning thereto, the operator can move valve 63 to reverse the position of the breaker plates 27 such that the right hand breaker plate will move to open the gap 68 and allow that material to escape by by-passing the grate 31. When it becomes necessary to reverse the breaker plates 27 to rid the mill of some hard-to-reduce object, it is within the control of the operator to reverse the normal rightward travel of conveyor belt 69 so that the object allowed to by-pass the grate 31 through space 68 can be dumped onto conveyor 52A where it will be moved to a suitable location with material falling onto conveyor 52A. It is considered conventional to be able to reverse the normal rightward travel of the conveyor 69 and any suitable reversible drive (not shown) for that conveyor may be employed. Observing the indicated direction of rotation of assembly 22 in FIG. 1, the breaker plate 27 in the moved-in position is the operative plate and the opposite breaker plate is positioned for guiding the hard-to-reduce material upwardly to follow the arched wall 13. When a hard-to-reduce fraction repeatedly returns to the assembly 22 the inbreaker plate can be moved back to open the escape space 68.

Figure 5:
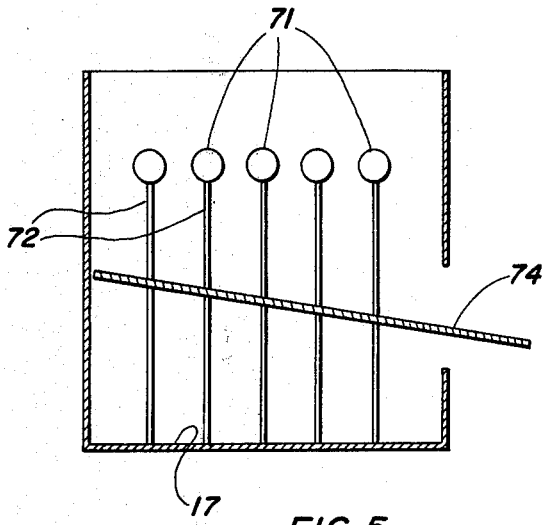
FIG. 5 is a transverse view partly in section of means for sorting waste, the view being taken along line 5—5 in FIG. 1.

FIG. 1 shows the further arrangement of means to sort out objects in the stream of trash and waste material so as to avoid the chance that such objects might become lodged in the conduit 47 and disrupt the intended operation. The feeding means includes a sorting device 70 disposed in the open top feeder 15 to which conveyor C delivers the waste. The device 70 (FIGS. 1 and 5) is composed of an array of tubular elements 71 each fixed to the upper longitudinal margin of a thin sheet 72, the bottom edge of each sheet 72 is secured to the bottom wall 17 of the vibratory tray structure which is vibrated longitudinally and causes objects falling onto the tubes 71 to fall through the spaces between tubes 71 and be collected in the tray structure. The large objects do not fall through the spaces but are caused to be vibratorially advanced to a position where they fall off the ends 73 and onto a slanted chute 74. The chute diverts the oversize objects off to one side of the tray where they can be processed by other means. The waste objects which are able to pass through the spaces between elements 71 are advanced off the end 16 and treated as above described. It can be appreciated that the presence of the sorting device 70 keeps large objects out of the stream of objects and accomplishes the intended purpose which is to prevent having to dismantle the assembly when an oversize object gets stuck in the conduit space 47A. The space between elements 71 is related to the size of the space 47A.

What is claimed is:

1. In material reducing apparatus for handling trash and waste material having an enclosure defining an upper material mixing portion and a lower material reducing portion in communication, a rotary impact assembly operably mounted in said lower material reducing portion of said enclosure, an air flow conduit having a discharge end, the discharge end opening into said upper enclosure mixing portion, a material chute having an open end communicating with said air flow conduit, air flow generating means connected to said air flow conduit for moving air through said conduit into said upper mixing portion of said enclosure, and primary trash and waste material feeding means having a discharge end opening into said upper mixing portion adjacent said air flow conduit discharge end, the improvement comprising: means forming a pocket disposed beneath said discharge end of said primary feeding means and at one side of said air flow conduit discharge end; and air flow velocity control means operable in said air flow conduit between said air flow generating means and said pocket, said control means restricting the cross-section of said air flow conduit to create air flow velocity with a consequent creation of a negative pressure gradient in said pocket for causing material passing off said discharge end of said feeding means to enter into said pocket at a velocity to effect specific gravity separation of material such that high specific gravity material falls against the air flow into said material chute and the lesser specific gravity material is propelled in the air stream flowing into said upper mixing portion of said enclosure.

2. The improvement set forth in claim 1, wherein sorting means is carried by said primary feeding means and consists of an array of spaced elongated elements raised about said primary feeding means in position to first receive the trash and waste material for separating out oversize objects incapable of passing between said spaced elements and allowing other trash and waste material objects to pass through the spaces between said array of spaced elements, and diverting means is positioned relative to said elongated elements for directing the oversize objects out of said primary feeding means.

3. The improvement set forth in claim 2, wherein said primary feeding means is movable in a back-and-forth vibratory motion for agitating and advancing the oversize objects in the trash and waste material toward said diverting means; and said pocket forming means is provided with a flexible wall connected to said primary feeding means such that the vibratory motion of said primary feeding means is substantially isolated from said pocket forming means.

4. The improvement set forth in claim 1, wherein said air flow velocity control means is a gate member movable across said air flow conduit for varying the restriction in the cross-section of said conduit to regulate the velocity of the air flow between said gate member and the discharge end of said conduit at said mixing portion of said enclosure.

5. The improvement set forth in claim 1, wherein said air flow velocity control means is made up of a fixed throat portion and a cooperating movable throat portion, together forming a venturi located in advance of said material chute opening into said air flow.

6. The improvement set forth in claim 1, wherein said air flow past said pocket creates a negative pressure gradient therein such that material passing from said discharge end of said feeding means is flipped and turned with increased velocity into said pocket and high specific gravity fractions penetrate said air flow conduit against the air flow therein and said material chute being in position for receiving and conducting such fractions out of said apparatus.

7. In material reducing apparatus for handling trash and waste material having an enclosure providing an upper material receiving and mixing area defined in part by an arched wall and a lower material reducing area in communication with said upper area below said arched wall, trash and waste material feeding means having a discharge end opening into said upper area of said enclosure, air flow directing means having an outlet connection in said enclosure adjacent said discharge end of said feeding means, a rotary impact assembly operably mounted in said lower material reducing area, said assembly having breaker plate means selectively positionable for directing unreducable objects toward said arched wall to follow the arched form and return to said feeding means, the improvement of means forming a pocket adjacent said feeding means discharge end and at one side of said air flow directing means outlet; air blower means having an outlet connected to said air flow directing means to create a flow of air therein; adjustable air flow restricting means in said air flow directing means spaced from said pocket for generating an increase in velocity of the air flow and a reduction in pressure at said pocket whereby said unreducable objects are drawn into said pocket and move counter to the direction of air flow; and means communicating with said air flow directing means adjacent said flow restricting means for directing the unreducable objects out of said air flow directing means, whereby unreducable objects directed by said arched wall to return to said feeding means are removed from the apparatus.

* * * * *